US006832460B2

(12) United States Patent
Fligg

(10) Patent No.: US 6,832,460 B2
(45) Date of Patent: Dec. 21, 2004

(54) METHOD AND APPARATUS FOR INSULATING BUILDING ROOFS FROM ABOVE

(76) Inventor: Robert E. Fligg, 2501 Jordan Grove, West Des Moines, IA (US) 50265

( * ) Notice: Subject to any disclaimer, the term of this patent is extended or adjusted under 35 U.S.C. 154(b) by 0 days.

(21) Appl. No.: 10/369,409

(22) Filed: Feb. 18, 2003

(65) Prior Publication Data

US 2004/0159063 A1 Aug. 19, 2004

(51) Int. Cl.[7] ..... E04G 21/00

(52) U.S. Cl. ..... 52/746.11; 52/745.06; 52/407.3; 52/407.4

(58) Field of Search ..... 52/407.3, 407.4, 52/404.5, 746.11, 749.12, 745.06

(56) References Cited

U.S. PATENT DOCUMENTS

| | | | | |
|---|---|---|---|---|
| 5,442,890 A | * | 8/1995 | Fligg | 52/742.12 |
| 5,636,487 A | | 6/1997 | Fligg | |
| 5,664,740 A | | 9/1997 | Alderman et al. | |
| 5,720,147 A | * | 2/1998 | Wenrick et al. | 52/745.06 |
| 5,724,780 A | * | 3/1998 | Bolich | 52/407.4 |
| 5,884,449 A | | 3/1999 | Alderman et al. | |

OTHER PUBLICATIONS

Copy—5 sheets of a folder entitled ELAMINATOR® Insulation System—The Faster, Safer Way to Install Roof Insulation by Owens Corning® and 13 sheets that are inserts.

Copy of a brochure by L & L Insulation & Supply Co. (10 sheets) which also shows the ELAMINATOR Insulation System by Owens Corning.

* cited by examiner

*Primary Examiner*—Naoko Slack
(74) *Attorney, Agent, or Firm*—Sturm & Fix LLP

(57) ABSTRACT

There are advantages to installing roof insulation in industrial and commercial buildings from above, rather than from below after the roof is sealed. A reinforced facing sheet is used that is rolled out between purlins. This facing material is used to support the insulation from below. The facing sheet is anchored to reduce pillowing of the insulation. The anchoring system for the facing material comprises a metal angle, firmly affixed to the top of a rafter between purlins. The facing material is sandwiched between the angle and the rafter, and anchored. A channel-shaped lower support member is located beneath the facing material and the angle is pressed, from above, into the open part of the channel shape as it is situated on top if the rafter. Consequently, the facing material is also pressed into the lower support member, thus holding the facing material at the correct elevation.

14 Claims, 9 Drawing Sheets

METHOD AND APPARATUS FOR INSULATING BUILDING ROOFS FROM ABOVE

BACKGROUND OF THE INVENTION

1. Field of the Invention

The present invention relates generally to building insulation. More particularly the present invention relates to a method and apparatus for installing insulation in the roof of a commercial or industrial building from above. The invention makes use of a new manner of anchoring the reinforced facing providing support for the insulation at the bottom.

2. Background Art

Fiberglass insulation has many advantages. It is not flammable, it provides good R-value, and it is nontoxic. It can be installed from below after the roof is finished to protect the insulating materials from the elements. It is also possible to install the insulation from above before the roof is sealed off. It is preferred to insulate new roofs from above for efficiency as well as the comfort of those carrying out the insulating.

Steel buildings typically have steel I-beam rafters running from an outside wall to the ridge of the roof. Attached to the top of these rafters and perpendicular to them are purlins. The purlins provide the structure to which the steel roofing is affixed. It is between the purlins, above the I-beam rafters and beneath the steel roofing that insulation is typically installed.

Installing insulation from above in new buildings is not new. An apparatus for dispensing insulation in the roof-section of industrial and commercial buildings from above is revealed in U.S. Pat. No. 5,921,057 by Alderman et al. The apparatus uses the purlins as tracks on which to run from one end of the building to the other. A support sheet, for providing support for the insulation at the bottom is also dispensed by the apparatus of U.S. Pat. No. 5,921,057. This support sheet is suspended from the tops of the purlins. Methods for anchoring the support sheet at intervals along the purlins for the purpose of keeping the support sheet tight and preventing pillowing are not described.

U.S. Pat. No. 5,636,487 to Fligg discloses an invention for insulating pre-existing roofs from below. It incorporates further support for insulating material between purlins as well as a method for anchoring a reinforced facing material support sheet at the ends. The method of anchoring the reinforced facing material is not immediately applicable to installation of insulation from above.

There is, therefore, a need for a method and device for anchoring supportive facing material when installing insulation from above in a steel building. Furthermore, there is a need for such anchoring to occur periodically across the building to reduce pillowing and improve the appearance of the insulating job from below.

SUMMARY OF THE INVENTION

A purpose of this invention is to provide a simple and effective method and apparatus for anchoring supporting facing material located at the bottom of the insulation layer between purlins in a steel building when insulating from above before the roof is finished.

A structural frame comprising vinyl lower support members (with a cross-section shaped like a channel), supported by four-way lower support brackets is fully disclosed in U.S. Pat. No. 5,636,487 which is hereby incorporated by reference. The lower support members running adjacent to and parallel with the beam rafters are oriented with their open side facing upward. Metal angles, placed parallel to the rafters and centered between purlins are anchored to the tops of the rafters and extend down into the channel created by the lower support member.

The facing material is rolled out between the purlins. At desired locations next to rafters, the facing material is pressed into the channel created by the lower support member. The angle is also pressed into the same space and affixed firmly to the top of the rafter, trapping the facing material and anchoring it between the metal angle and the rafter. Therefore, it is effectively held in place so the weight of the insulation will not cause excessive pillowing. The facing material loops under the angle, within the channel-shaped lower support member, so it is supported by the lower support member as the facing material extends away from the rafter. This gives the facing material the support it needs at the correct elevation.

The novel features which are believed to be characteristic of this invention, both as to its organization and method operation together with further objectives and advantages thereto, will be better understood from the following description considered in connection with accompanying drawings in which a presently preferred embodiment of the invention is illustrated by way of example. It is to be expressly understood however, that the drawings are for the purpose of illustration and description only and not intended as a definition of the limits of the invention.

BEST MODE FOR CARRYING OUT THE INVENTION

Figure 1:
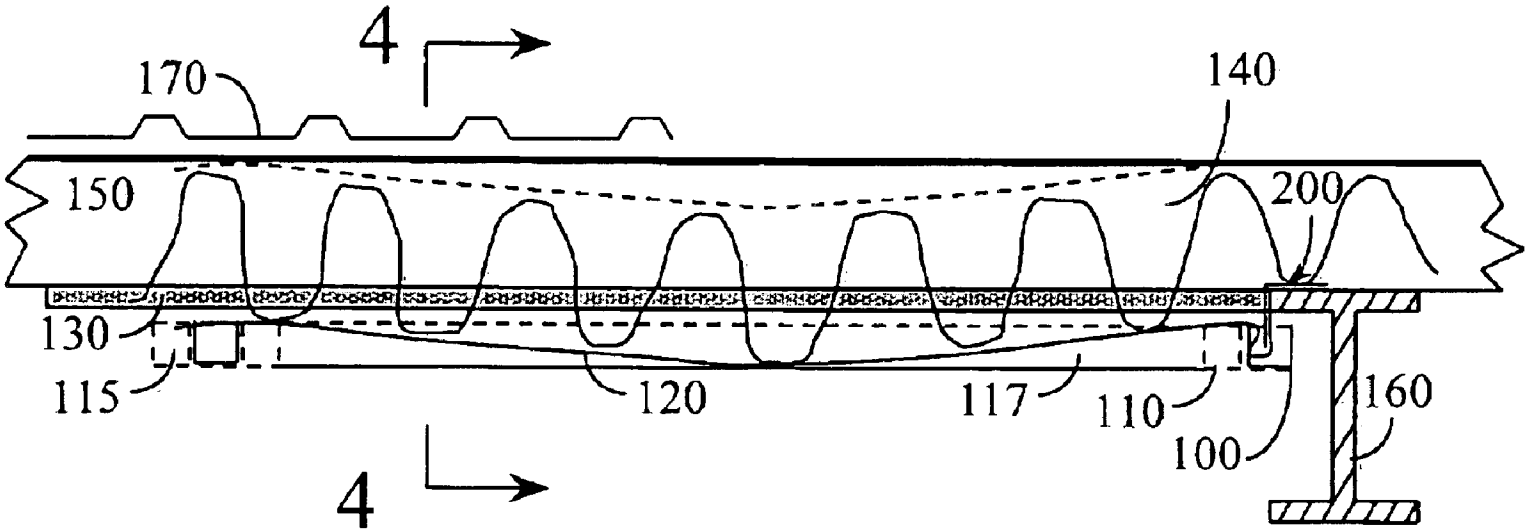
FIG. 1 shows a side elevation view with a cutaway view of the insulation support system.

An insulation system includes several aspects as shown in FIG. 1. On the bottom, the vinyl lower support members 100, themselves supported by three-way lower support brackets 110 provide a support grid for the insulation blanket. The three-way lower support brackets are suspended from purlins by purlin clips (not shown). Additional parts of the lower support system are lower support cross brace 117 and four-way lower support brackets 115.

Under the insulation is a reinforced facing material 120 such as that sold by Alpha Associates, Inc. of Woodbridge, N.J. Optionally, a lower layer of foam insulation board 130, three quarters to one inch thick as a spacer block, can be applied to the underside of the purlins. A fiberglass blanket 140, approximately as thick as the height of a purlin 150 is installed between the purlins 150. Purlins 150 are supported by I-beam rafters (or the top chord of a truss) 160. The steel sheet roofing 170 installs above the fiberglass blanket 140.

Figure 2:
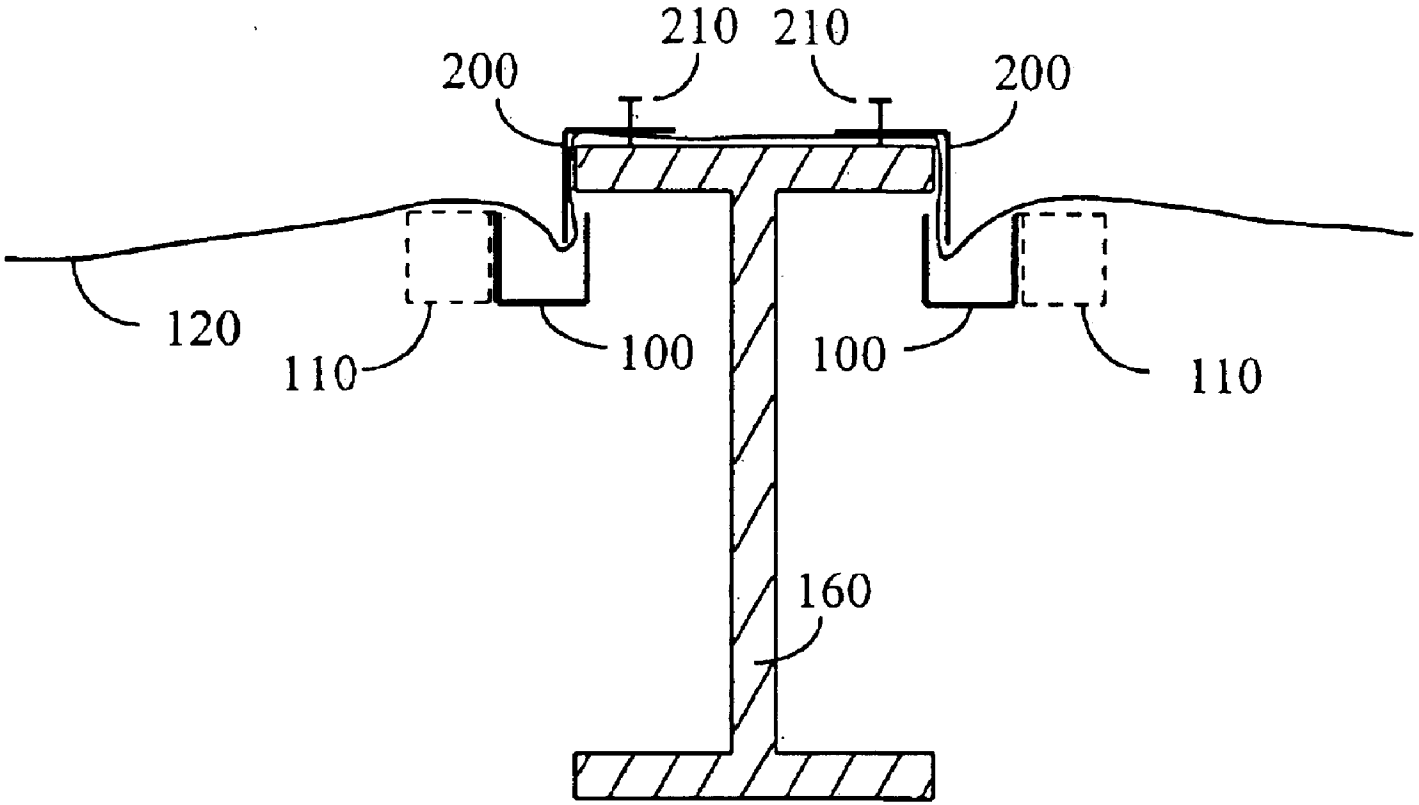
FIG. 2 shows a close-up of a facing material anchoring assembly from the end of an I-beam.

A detailed schematic of the present invention is shown in FIG. 2. Two lower support members 100 are shown being supported by two lower support brackets 110, both the lower support members 100 being adjacent to an I-beam rafter 160. Reinforced facing material 120 is shown on top of I-beam rafter 160. After crossing the I-beam rafter 160, the reinforced facing material 120 is pressed into the channel-shaped lower support members 100 by metal angles 210. Metal angles 200 are affixed to the I-beam rafter 160 by fasteners 210. Suitable fasteners for the preferred embodiment include self-drilling screws and gun powder-actuated fasteners. For the preferred embodiment, the metal angles 210 will have dimensions of 1.75"×1.75"×48". Each metal angle 210 will be roughly centered between purlins. The reinforced facing material 120 is held stationary under the metal angles 200; that is, sandwiched in between the angles 200 and I-beam rafter 160. By passing the reinforced facing material 120 under the edge of the metal angles 210 within the lower support members 100, it is held at the appropriate elevation as it passes, once again, out of the channel-shaped lower support members 100.

Figure 3:
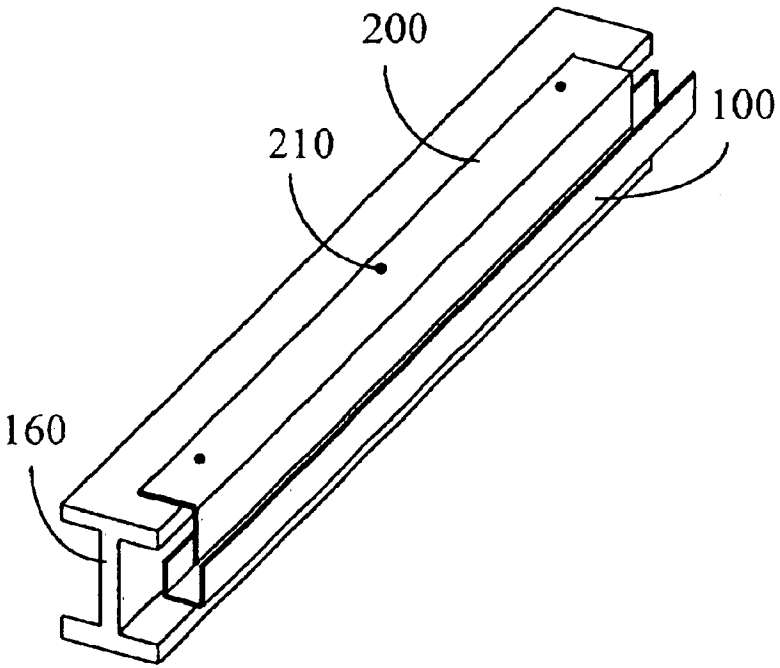
FIG. 3 shows a perspective view of the anchoring system.

A perspective view of the anchoring system is shown in FIG. 3, where anchoring is only shown on one side of an I-beam. The lower support member 100 is shown in place adjacent and parallel to the I-beam rafter 160. The metal angle 200 is shown attached to I-beam rafter 160 with suitable fasteners 210. For clarity, the reinforced facing material 120 is not shown in FIG. 3.

Figure 4:
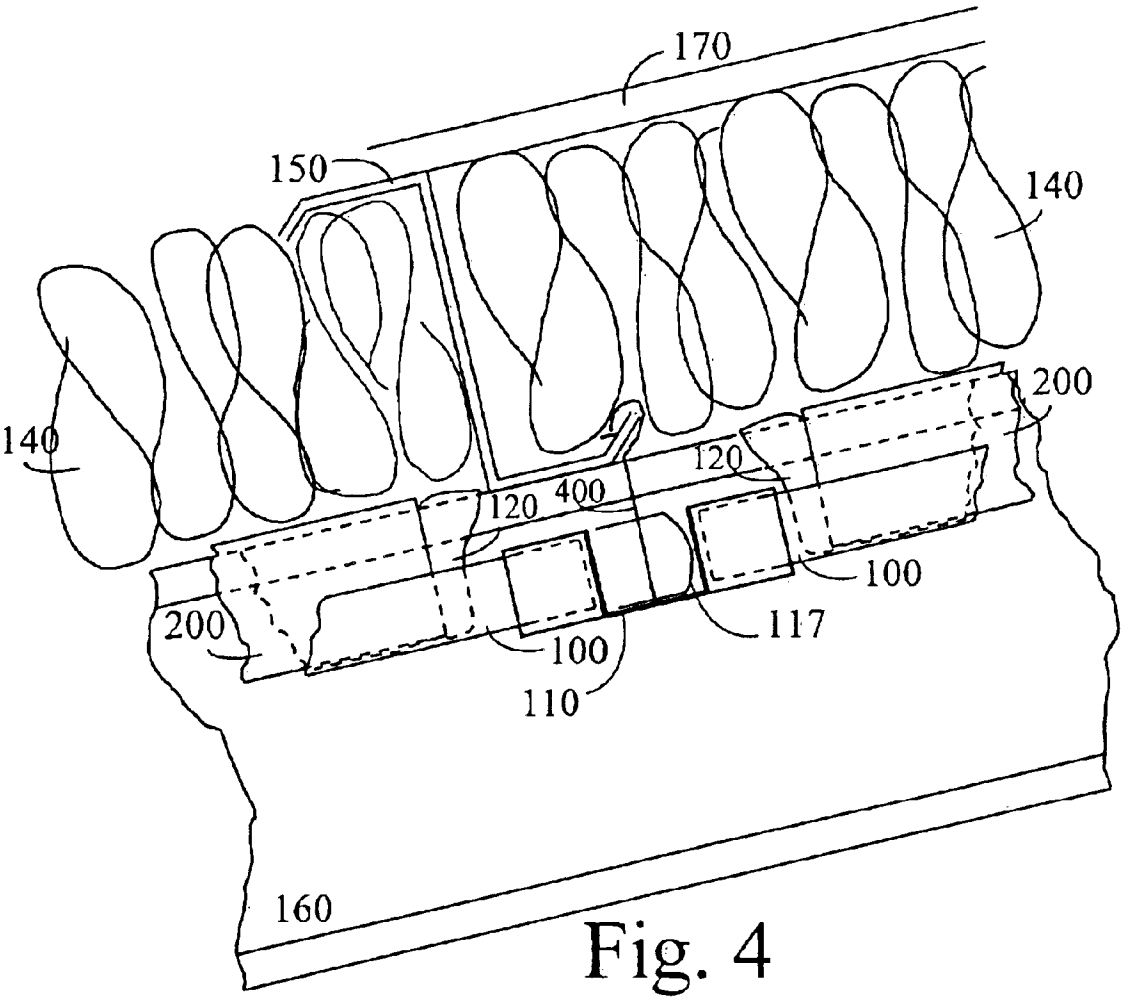
FIG. 4 shows another cutaway view of the insulation support system.

A cutaway view (perpendicular to that of FIG. 1) is shown in FIG. 4. A three-way lower support bracket 110 is shown with a lower support cross brace 117 and lower support members 100 installed therein. The lower support bracket 110 is suspended by a purlin clip 400 clipped to purlin 150. The metal angle 200 is shown anchoring the reinforced facing material 120, which is pressed into the lower support members 100. The reinforced facing material 120 is sandwiched between the metal angle 200 and the I-beam rafter 160. The insulation 140 is shown. It is supported by the reinforced facing material 120 and lies under the steel sheet roofing 170. The foam insulation board 130 is not shown in FIG. 4.

Figure 5:
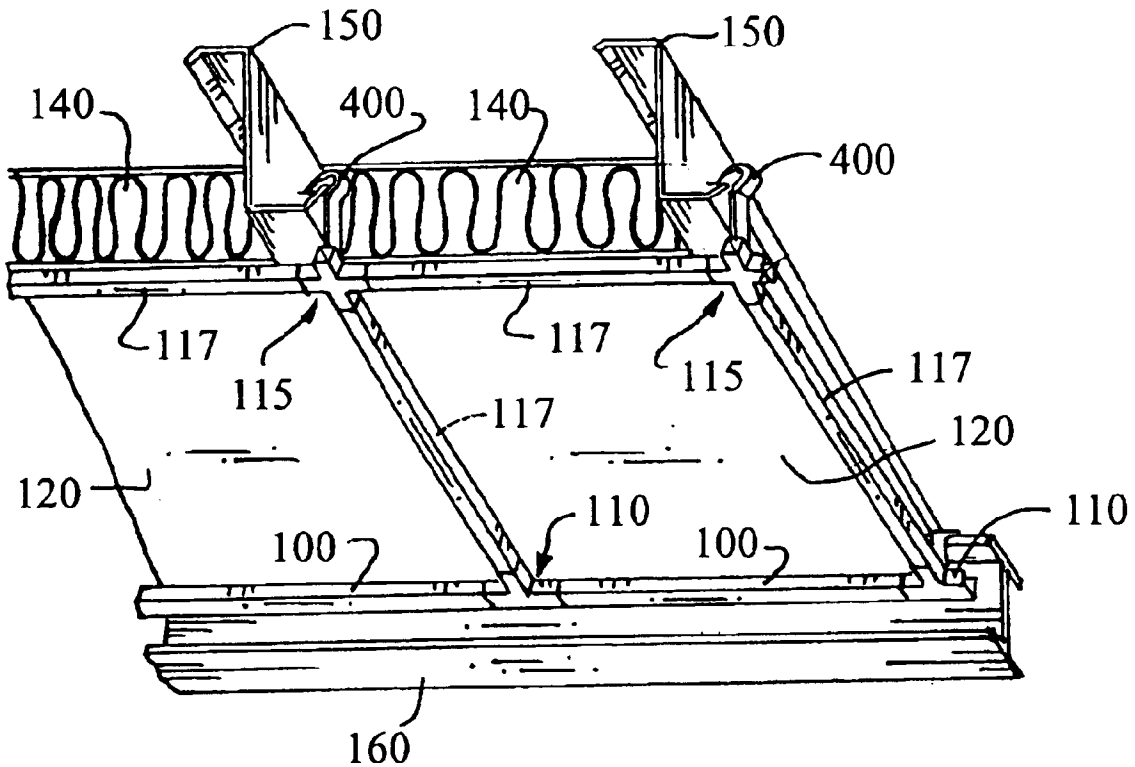
FIG. 5 shows an underside view of the insulation system.

The insulation system is shown as it would be viewed from below in FIG. 5. The lower support cross braces 117, supported by three-way lower support brackets 110 and four-way lower support brackets 115. The reinforced facing material 120 is clearly visible from this angle. The anchoring system used for the reinforced facing material 120 cannot be seen in FIG. 5. The fiberglass insulation 140 is shown installed between the purlins 150.

Figure 6:
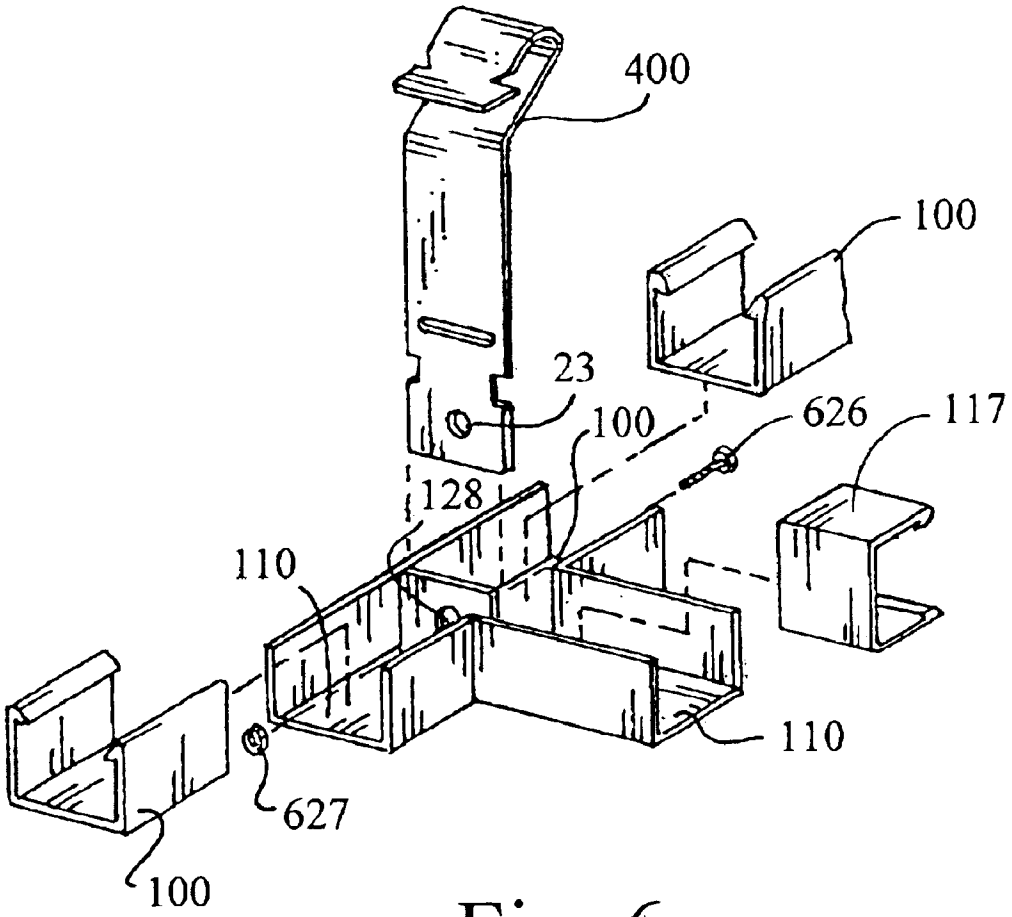
FIG. 6 shows an exploded view of a three-way lower support bracket assembly.

In FIG. 6, an exploded view of a three-way lower support bracket 110 assembly is depicted. The entire bracket is suspended from a purlin 150 by a purlin clip 400, which is made fast to the lower support bracket 110 using the hex bolt 626 and hex nut 627. The end of a lower support cross brace 117 is shown, as well as ends of two lower support members 100. The dashed lines indicate where each of these elements fit into the lower support bracket 110.

Figure 7:
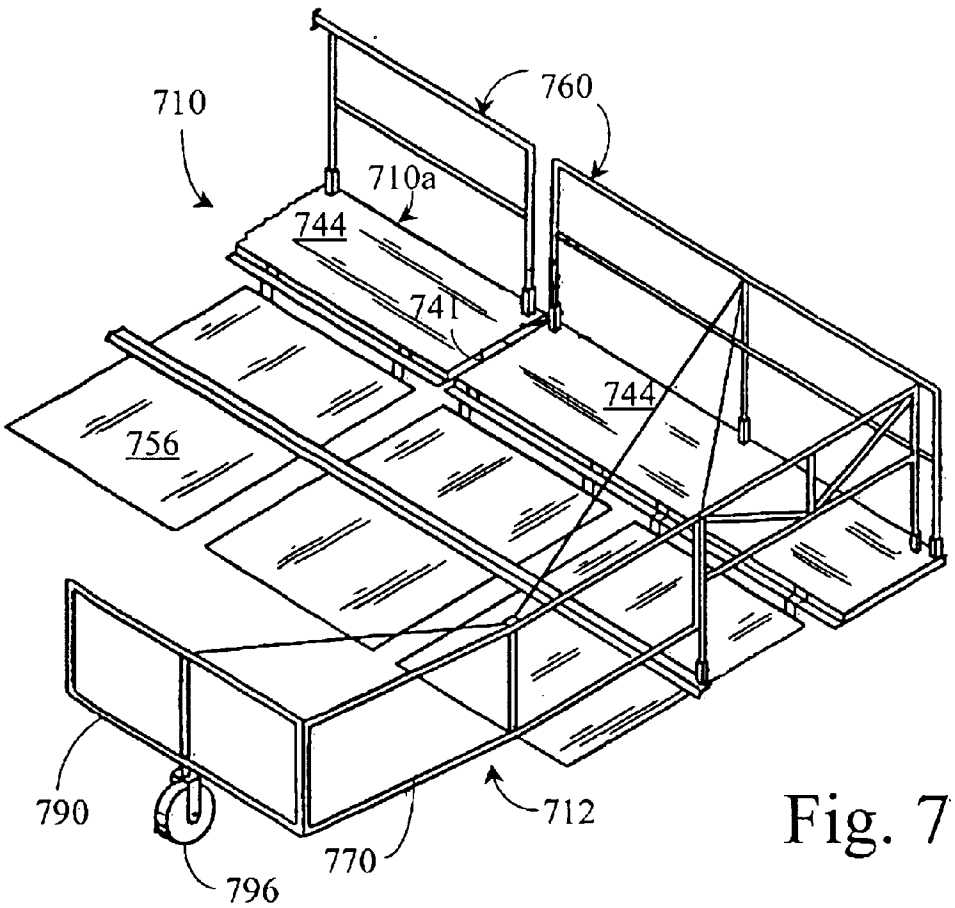
FIG. 7 shows a perspective view of a carriage for installing insulation to roofs from above.

Referring to FIG. 7, there is shown a carriage 710 having a guardrail assembly 712 in accordance with the present invention. Such a carriage is disclosed in U.S. Pat. No. 6,233,894 B1 by Abney et al., and is herein incorporated by reference.

Figure 8:
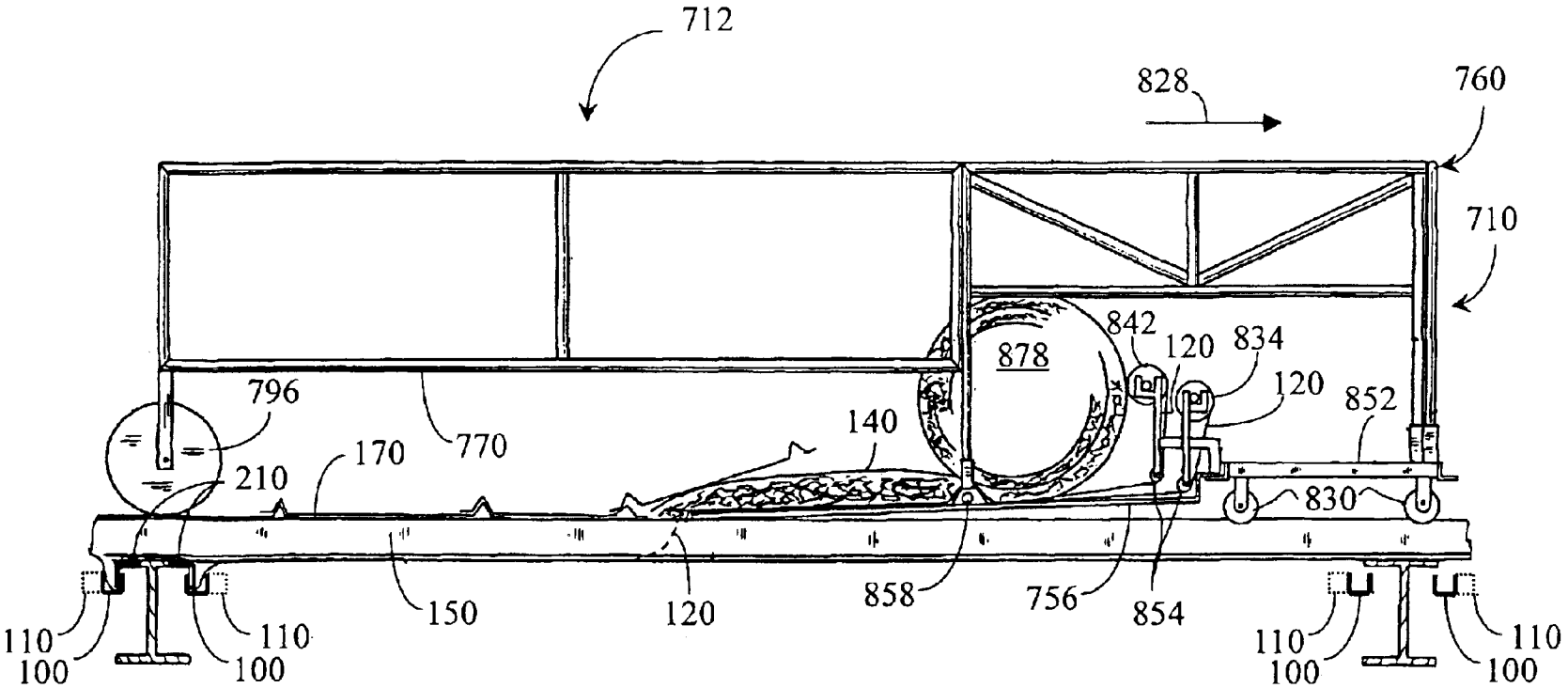
FIG. 8 shows a first side elevation view of the carriage for installing insulation to roofs from above.

In FIG. 8, the carriage 710 is shown riding on the purlins 150 (one visible) and travels along the length of the purlins 150 in a direction represented by an arrow 828. The carriage has rollers 830, rotatably mounted on the carriage, which roll along the upper surface of the purlins. As the carriage is moved, a reinforced facing material 120 is paid out from rolls 834 and 842, as will be discussed below. The reinforced facing material 120 supports a layer of insulation material 140 which is placed on top of the support sheet between the adjacent purlins 150. The insulation material 140 is typically dispensed from a roll 878.

After the insulation material has been placed on the support sheet, sheets of metal roofing material 170 are then attached to the upper portion of the purlins 150 over the support sheet and insulation. The metal roofing material can be fastened to the purlins 150 in any suitable manner, such as by threaded fasteners.

As seen in FIG. 7, the carriage is comprised of a plurality of carriage sections 710*a* which are joined together. The carriage sections 71*a* are joined at their respective ends 741 so that they are generally in alignment with each other. The carriage sections 710*a* can be joined together by any suitable manner, such as by being clamped or bolted together. Preferably, the carriage 710 spans the entire width of the sloped section of the roof, but it can be any length up to the width of the roof itself.

In carrying out the insulating process, the carriage 710 is propelled across the purlins 150 in the direction shown by the arrow 828. The carriage 710 can be propelled in any suitable manner, such as pulled by a winch and cable. As the carriage 710 moves along the length of the purlins 150, the reinforced facing material 120 is draped between the adjacent purlins 150. Adjacent support sheet rolls 842, 834 may be positioned in a staggered and offset manner such that their axes are not co-linear, one with another as shown in FIG. 8. Preferably, a carriage section 71*a* covers two purlin spans. Each carriage section preferably has both a leading roll 834 and a trailing roll 842 of insulation support sheet, one roll for each of two adjacent purlin spans. Multiple identical carriage sections 710*a* having a leading and trailing roll and can, therefore, be joined together, with every roll being staggered from an adjacent roll. Note that the rolls of support sheet 834 and 842 have been removed from the carriage 710 in FIG. 7 for clarity. The carriage includes a walk platform 744 on which the workers walk or stand while carrying out the insulation process. The platform 744 preferably extends the width of the carriage 710 to provide a continuous platform. The carriage also includes a framework 852 for rotatably mounting the rolls 834 and 842, as best shown in FIG. 8. Mounted on the framework are rollers 854 which extend laterally across associated reinforced facing material 120 and are positioned slightly above the upper surface of the purlins 150 so as to direct the support sheet to a substantially horizontal position.

Attached to the carriage 710 is an optional plate 756 which extends from the carriage 710 in a direction opposite the direction of travel 828. The optional plate 756 supports the paid out portion of the reinforced facing material 120 and insulation material 140 so that the reinforced facing material 120 does not drape downwardly. If sufficiently built, the optional plate 756 can be used for fall protection for the workers to prevent them from falling off the leading edge of the previously completed section of roof. The optional plate 756 can be attached to the carriage 710 by any suitable means. Preferably, the optional plate 756 has wheels 858 which also support the optional plate 756 by rolling along the purlins 150. However, it is not required that the paid out reinforced facing material 120 be supported by the optional plate 756. The carriage 710 could be modified so that the reinforced facing material 120 is paid out in such a manner that the reinforced facing material 120 is underneath the optional plate 756. If desired, the roll 838 of insulation material 140 could be positioned on the optional plate 756 above the reinforced facing material 120.

As shown in FIGS. 7 and 8, each of the carriage sections 71*a* preferably includes a platform railing 760 attached thereto. The platform railings 760 extend in a lateral direction normal to the direction of travel 828 and are positioned at the front edge of the platform 744. The platform railings function as a barrier from the leading edge of the roof structure for the workers on the platform 744.

The guardrail assembly 712 protects the workers from inadvertently going past the edge of the platform 744. Preferably, a guardrail assembly 712 is located next to each end of the carriage 710. The guardrail assembly 712 includes an edge railing 770 extending in a direction generally parallel to the direction of travel 828. The edge railing 770 can be attached to the carriage by any suitable manner.

The guardrail assembly 712 can also include an optional back railing 790, as illustrated in FIG. 7. The back railing 790 is attached to the end of the edge railing 770 and extends at an approximately right angle when compared to the direction of travel 828. The back railing 790, the edge railing 770, and the platform railing 760 cooperate to contain the workers working along the lateral edge of the roofing structure into a secure working zone defined between the railings 760, 770, and 790. Thus, the workers within this secure working zone may not need to be tied off to the roof structure.

The guardrail assembly 712 can include a roller 796 rotatably mounted thereon to provide vertical support for the edge railing 770 and the back railing 790. In the embodiment of the guardrail assembly 712 illustrated in FIGS. 7 and 8, the roller 796 is mounted on the back railing 790. Of course, the roller can be mounted on the edge railing 770 if desired. As the guardrail assembly 712 travels along the roof structure, the roller 796 simply rolls along the top surface of the sheets of roofing material 170. Preferably, the diameter of the roller 796 is large enough so that the roller 796 will not become obstructed by laterally extending ridges formed on the sheets of roofing material 170. Multiple rollers 796 may also be used. Instead of a roller, the guardrail assembly 712 can have any other suitable support member which vertically supports the guardrail assembly 712 and allows the guardrail assembly 770, 790 to move horizontally along the roof structure, such as for example, a sliding member.

The edge railing 770 and the back railing 790 can be any desired length. Preferably, the edge railing is between 3 to 6 meters in length, and the back railing is preferably greater than 2 meters in length.

Figure 9:
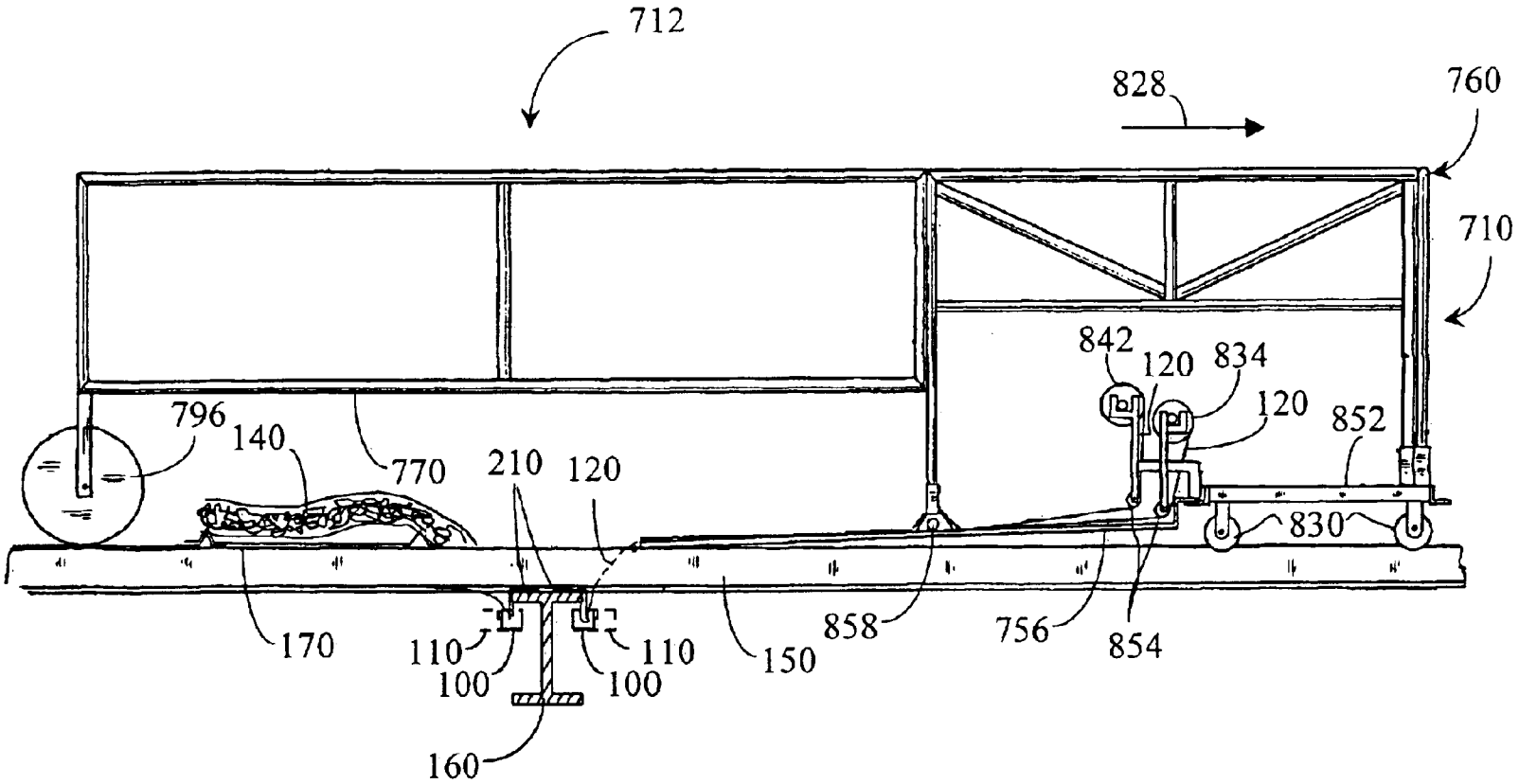
FIG. 9 shows a second side elevation view of the carriage in position for the operator to anchor the support sheets.

When the carriage 710 is positioned in such a manner that the back of the platform 744, or if installed, optional plate 756, has just passed an I-beam, attachment of the reinforced facing material 120 to the I-beam is carried out by an operator. The carriage 710, outfitted with optional plate 756 is shown in such a position in FIG. 9. Because the lengths of insulation batts 140 are appreciably the same length as the distance between I-beams, when arriving to the position shown in FIG. 9, the end of the insulation batt 140 can easily be laid back over the roofing material (as depicted in FIG. 9) to provide room for the operator to anchor the reinforced facing material 120 with the metal angles 210.

The above embodiment is the preferred embodiment, but this invention is not limited thereto. The insulating method and apparatus disclosed herein is applicable to other configurations, including wood-framed buildings, insulation systems that do not make use of a lower support member, and the use of angle made of materials other than metal. It is, therefore, apparent that many modifications and variations of the present invention are possible in light of the above teachings. It is, therefore, to be understood that within the scope of the appended claims, the invention may be practiced otherwise than as specifically described.

What is claimed is:

1. A method for insulating roofs having structural members using an insulation anchoring system comprising reinforced facing materials a rigid angle, and channel-shaped lower support members, the method comprising the steps of:

(a) installing at least some of said lower support members adjacent and parallel to the structural members with an open side facing upward:

(b) drawing the reinforced facing material across a top of the structural member;

(c) pressing the reinforced facing material into the open top of the lower support members with a lower edge of the rigid angle; and (d) anchoring the rigid angle to the structural member such that the reinforced facing material is held firmly between said rigid angle and the top of the structural member.

2. The method of claim 1 wherein the structural member of the roof is a rafter.

3. The method of claim 2 wherein the rafters are steel I-beam rafters.

4. The method of claim 1 wherein the structural member of the roof is a truss.

5. The method of claim 1 wherein the rigid angle is fastened using suitable fasteners.

6. The method of claim 5 wherein the suitable fasteners are screws.

7. The method of claim 6 wherein the screws are self drilling screws.

8. The method of claim 5 wherein the suitable fasteners are gun powder-actuated fasteners.

9. The method of claim 1 wherein the roof is constructed using rafters and purlins.

10. The method of claim 9 wherein the purlins are steel purlins.

11. The method of claim 1 wherein an insulation system also includes a foam insulation board installed above the reinforced facing material.

12. The method of claim 1 wherein an insulation system also includes a fiberglass blanket.

13. The method of claim 1 wherein the rigid angle is made of metal.

14. The method of claim 1 wherein the step of drawing the reinforced facing material across the top of the structural member comprises the steps of:

(a) conveying said reinforced facing material in a roll along purlins that are supported by the structural member with an insulation installation apparatus suited thereto;

(b) unrolling the reinforced facing material from said roll as it is conveyed along the purlins; and (c) depositing the reinforced facing material between said purlins, and thereby across the top of the structural member, in a single sheet.

* * * * *